United States Patent [19]

Vugts

[11] Patent Number: 4,774,491

[45] Date of Patent: Sep. 27, 1988

[54] METAL FILM RESISTORS

[75] Inventor: Ludovicus Vugts, Eindhoven, Netherlands

[73] Assignee: U.S. Philips Corporation, New York, N.Y.

[21] Appl. No.: 50,827

[22] Filed: May 15, 1987

[30] Foreign Application Priority Data

Jun. 4, 1986 [NL] Netherlands ..... 8601432

[51] Int. Cl.[4] ..... H01C 1/012

[52] U.S. Cl. ..... 338/306; 338/313

[58] Field of Search ..... 338/306–314, 338/275, 279, 283, 284, 292, 293

[56] References Cited

U.S. PATENT DOCUMENTS 3,904,461 9/1975 Estep et al. ..... 338/308 X 4,529,958 7/1985 Person et al. ..... 338/275

FOREIGN PATENT DOCUMENTS 1338735 11/1973 United Kingdom .

*Primary Examiner*—H. Broome
*Assistant Examiner*—M. M. Lateef
*Attorney, Agent, or Firm*—Norman N. Spain

[57] ABSTRACT

A metal film resistors consisting of an Ni-Al alloy with an Al content of at least 14.5 and at most 22% by weight with a maximum of 2.5% by weight of compatible contaminants are disclosed. Those can be used in the resistance range between 0.5 Ohm and 5 KOhm, are very stable and can be obtained with a low temperature coefficient of the resistance below ±50 ppm/° C. between −55° C.−+150° C.

2 Claims, 1 Drawing Sheet

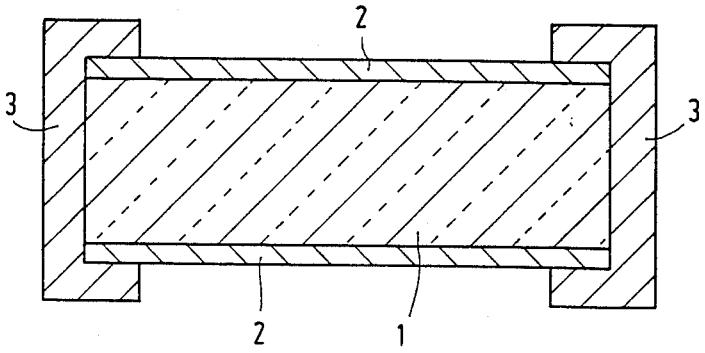
2
3
3
2
1

METAL FILM RESISTORS

BACKGROUND OF THE INVENTION

The invention relates to electric metal film resistors having a nickel alloy as a resistance material.

Such resistors are known from GB-PS 1,338,735 having an Ni-Cr-Al alloy as a resistance material, in which $15 \leqq Ni \leqq 55$ $10 \leqq Cr \leqq 68$ and $2 \leqq Al \leqq 60$, expressed in % by weight.

These resistors which are manufactured by providing the alloy on a substrate surface by sputtering and then stabilising them by heating them in an oxygen-containing atmosphere and which have resistance values be are readily produced on an industrial scale from approximately 5 Ohm to 1 M Ohm. They have a temperature coefficient of the electric resistance with a value between $\pm 25 \times 10^{-6}$/°C. in the temperature range from −55° to +155° C.

Resistors of this material with a value below 5 Ohm can be made by sputtering, it is true, but then it is necessary to sputter for a very long period of time, for example, for 10 hours, to obtain a resistor of 0.5 Ohm and for this purpose a power of 8 kW per 40,000 pieces is necessary. In practice this is not acceptable. For this value it has therefore been endeavoured to use nickel-phosphorus as a resistance material which is deposited on a nucleated substrate by means of an electroless nickel plating bath. The quality requirements which are used for resistors above 5 Ohm manufactured by sputtering, can by no means be realised by means of these electroless nickel plated resistors.

Resistance bodies for applications in which high powers (>1W) are dissipated may reach a temperature of approximately 300° C. during operation. However, they must remain stable also after a long period in use in which said operating temperature is reached several times, is maintained for some time, after which the resistance body is again cooled to room temperature. Another category of low ohmic resistors are the so-called precision resistors. These resistors must have a temperature coefficient of the resistance value between $\pm 25 \times 10^{-6}$/°C.

Furthermore, the layer provided by sputtering must have a high resistance to detrition. Sputtering as a matter of fact takes place in a rotating drum in which the carriers to be coated can move freely and rub along each other with some force. When the layer consists of a material having a low resistance to detrition this means that the sputtering time is prolonged as a result of the detrition and moreover that the homogeneity of the deposition is disturbed and hence the appearance of the products is deteriorated.

The known resistance materials which are provided by sputtering, for example the above mentioned Ni-Cr-Al alloy, but also alloys of Ni-Cr or Ni-Cu, cannot satisfy all these requirements.

Ni-Cr, for example, has a lower level of the resistivity than an Ni-Cr-Al alloy but a temperature coefficient of the resistance of approximately $140 \times 10^{-6}$/°C. Both alloys have a rather low resistance to detrition.

Another binary alloy, Ni Cu, having a low resistivity, cannot be used either. Ni Cu (30/70% by weight) can be sputtered by means of a magnetron sputtering apparatus, but it proved to have a temperature coefficient of the resistance of $100\text{–}150 \times 10^{-6}$/°C. and moreover a great variation upon ageing. A lot of dust is formed during the sputtering as a result of the high detrition in the drum and the layer has a poor bonding to the ceramic.

SUMMARY OF THE INVENTION

The invention provides a resistance material for the low resistance values having an absolute value of the temperature coefficient of the resistance in the temperature range from −55° to +150° C. below $50 \times 10^{-6}$/°C. and even below $25 \times 10^{-6}$/°C. and having a resistance to detrition which has an acceptable value for the manner of manufacturing by sputtering in a drum on freely moving resistance carriers.

According to the invention, a film resistor for resistance values below 10 Ohm and an absolute value of the temperature coefficient of the resistance below $50 \times 10^{-6}$/°C. between −55° and 150° C. is characterized in that the film resistor consists of an alloy of nickel and aluminum with an aluminum content of at least 14.5 and at most 22% by weight, the balance being nickel, not counting compatible contaminants with a maximum of in all 2.5% by weight.

BRIEF DESCRIPTION OF THE DRAWING

The sole FIGURE of the drawing is a cross-sectional view of a resistor of the invention.

DETAILED DESCRIPTION OF THE INVENTION

For use as a precision resistor it is required that the absolute value of the temperature coefficient of the resistance be below $25 \times 10^{-6}$/°C. between −55° and +150° C. According to a preferred embodiment of the resistor this is achieved when the alloy of nickel and aluminum has an aluminum content of at least 16.5 and at most 18.5% by weight.

The resistance layers are provided by sputtering, preferably by means of magnetron sputtering.

An excellent stability of the resistors is obtained by ageing in known manner in an oxygen-containing atmosphere, for example in air, at a temperature above 300° C.

The manufacture of a number of types of resistors according to the invention will now be described in greater detail, by way of the following example and with reference to the drawing.

A number of porcelain rods having a diameter of 1.7 mm and a length of 6 mm with a target of Ni-Al with a varying content of Al were covered with a layer of this alloy in a magnetron sputtering apparatus having a rotating drum. After providing the Ni Al layer the resistors were aged at various temperatures for 3 hours.

An Ni-Al resistance body thus obtained having a content of Al of 19.2% had a resistance value of 0.76 Ohm which increased to 0.86 Ohm after ageing for 3 hours at 350° C. The temperature coefficient of the resistance (TCR) in the range from +25° to +150° C. was $40 \times 10^{-6}$/°C.

A resistor manufactured from this resistor body is shown in cross-section in the drawing, is formed of a porcelain rod 1 coated with a layer 2 of this NiAl at alloy and is provided with contact 3.

A resistance body having an Al content of 17.2% had a resistance value of 1.1 Ohm and a temperature coefficient between 25° and 150° C. of $-22\times10^{6}$/°C. After ageing for 3 hours at 300° C. the resistance value had increased to 1.2 Ohm, the TCR in the range from −55° to +25° C. being $+5\times10^{-6}$/° C. and in the range from +25° to +150° C. being $-17\times10^{-6}$/°C.

An Ni-Al body having 14.2% Al outside the composition range of the invention had a resistance value of 1.1 Ohm, increasing to 1.3 Ohm after ageing at 300° C. for 3 hours with a TCR in the range from 25° to 150° C. of $350\times10^{-6}$/°C.

A likewise useless high value of the TCR was obtained with Ni-Al resistance bodies having Al contents above 22% by weight. The resulting resistors were subjected to a number of tests.

A life test at +70° C. in all resistance bodies gave a change in the resistance value which remained within ±¼% after 1000 hours.

A temperature variation test, consisting of 5 cycles of a residence of the resistance bodies at +155° C. for 30 minutes succeeded by a residence at −55° C. for 30 minutes gave a change of the value within ±¼% for all resistance bodies.

In the known vapour-deposited metal film resistors based on Ni Cr or Ni Cu these tests gave a greater variation of the resistance values.

What is claimed is:

1. An electric metal film resistor having a nickel alloy as a resistance material, characterized in that the resistance material consists of an alloy of nickel and aluminum with an aluminum content of from 14.5% to 22% by weight, the balance being nickel and compatible contaminants, said contaminants being present in a maximum of 2.5% by weight.

2. An electric metal film resistor as claimed in claim 1, characterized in that the resistance material consists of an alloy of nickel and aluminum with an aluminum content of at least 16.5 and at most 18.5% by weight.

* * * * *